US008109010B2

(12) United States Patent
Hamamoto

(10) Patent No.: US 8,109,010 B2
(45) Date of Patent: Feb. 7, 2012

(54) METHOD FOR DRYING APPLIED FILM AND DRYING APPARATUS

(75) Inventor: Nobuo Hamamoto, Odawara (JP)

(73) Assignee: Fujifilm Corporation, Tokyo (JP)

( * ) Notice: Subject to any disclaimer, the term of this patent is extended or adjusted under 35 U.S.C. 154(b) by 1138 days.

(21) Appl. No.: 11/861,808

(22) Filed: Sep. 26, 2007

(65) Prior Publication Data

US 2008/0075867 A1 Mar. 27, 2008

(30) Foreign Application Priority Data

Sep. 26, 2006 (JP) ..... 2006-261389

(51) Int. Cl.
*F26B 11/03* (2006.01)

(52) U.S. Cl. ..... 34/423; 34/497; 34/80; 34/611; 118/65; 118/58; 427/377

(58) Field of Classification Search ..... 34/427, 34/497, 80, 611; 118/65, 58; 427/377
See application file for complete search history.

(56) References Cited

U.S. PATENT DOCUMENTS 1,724,645 A * 8/1929 De Long ..... 101/424.1
2,413,735 A * 1/1947 Shabaker ..... 425/209
2,648,089 A * 8/1953 Mayer ..... 15/309.1
2,714,257 A * 8/1955 Reading ..... 34/85
2,924,273 A * 2/1960 Conley et al. ..... 159/12
2,928,329 A * 3/1960 Limbach ..... 134/62
2,932,864 A * 4/1960 Mellen, Jr. et al. ..... 164/516
3,059,345 A * 10/1962 Kaufman ..... 34/80
3,065,098 A * 11/1962 Brooks ..... 430/631
3,071,869 A * 1/1963 Latimer et al. ..... 34/114
3,078,589 A * 2/1963 Carlson ..... 34/77
3,147,090 A * 9/1964 Russell et al. ..... 34/653
3,151,950 A * 10/1964 Newman et al. ..... 34/267
3,203,111 A * 8/1965 Lorant et al. ..... 34/85
3,213,858 A * 10/1965 Merritt et al. ..... 131/372
3,216,638 A * 11/1965 Brickle et al. ..... 242/615.12
3,237,314 A * 3/1966 Smith, Jr. ..... 34/266
3,286,369 A * 11/1966 Smith, Jr. ..... 34/278
3,289,315 A * 12/1966 Smith, Jr. ..... 34/92
3,358,302 A * 12/1967 Candor ..... 8/159
3,393,532 A * 7/1968 Khoylian ..... 62/380
3,400,465 A * 9/1968 Von Stroh ..... 34/443
3,414,982 A * 12/1968 Oas ..... 34/519
3,559,301 A * 2/1971 Fraser ..... 34/641
3,590,495 A * 7/1971 Tyson et al. ..... 34/654
3,634,947 A * 1/1972 Furgal ..... 34/60
3,643,342 A * 2/1972 Tyson et al. ..... 34/555
3,667,130 A * 6/1972 Candor et al. ..... 34/250

(Continued)

FOREIGN PATENT DOCUMENTS

DE 102008052162 A1 * 5/2009

(Continued)

*Primary Examiner* — Stephen M. Gravini
(74) *Attorney, Agent, or Firm* — Sughrue Mion, PLLC

(57) ABSTRACT

The present invention provides a method for drying an applied film formed by applying an application liquid containing an organic solvent to a traveling long support medium, wherein the temperature Tb of the long support medium before application is not less than 2° C. lower than the temperature Tc of the application liquid and the wind velocity in the vicinity of the applied film after application is not more than 0.5 m/s, thereby the applied film is dried uniformly in the initial drying of the applied film.

8 Claims, 4 Drawing Sheets

U.S. PATENT DOCUMENTS 3,686,772 A * 8/1972 Drummond ..... 34/628
3,698,095 A * 10/1972 Grand et al. ..... 34/333
3,757,426 A * 9/1973 Candor et al. ..... 34/251
4,063,367 A * 12/1977 Talalay ..... 34/410
4,146,361 A * 3/1979 Cirrito ..... 432/60
4,148,575 A * 4/1979 Siryj ..... 396/575
4,255,037 A * 3/1981 Meadows et al. ..... 396/574
4,357,758 A * 11/1982 Lampinen ..... 34/331
4,365,423 A * 12/1982 Arter et al. ..... 34/463
4,462,169 A * 7/1984 Daane ..... 34/62
4,462,675 A * 7/1984 Moraw et al. ..... 399/250
4,501,072 A * 2/1985 Jacobi et al. ..... 34/267
4,638,571 A * 1/1987 Cook ..... 34/255
4,872,270 A * 10/1989 Fronheiser et al. ..... 34/421
4,959,976 A * 10/1990 Matsuda et al. ..... 62/271
5,052,125 A * 10/1991 Jensen ..... 34/444
5,077,570 A * 12/1991 Schell ..... 396/30
5,090,898 A * 2/1992 Smith ..... 431/326
5,120,506 A * 6/1992 Saito et al. ..... 422/66
5,197,202 A * 3/1993 Jensen ..... 34/464
5,201,132 A * 4/1993 Jacob ..... 34/393
5,293,699 A * 3/1994 Faust et al. ..... 34/642
5,342,446 A * 8/1994 Jongsma et al. ..... 118/65
5,452,524 A * 9/1995 Isozaki et al. ..... 34/454
5,471,847 A * 12/1995 Murray et al. ..... 62/91
5,536,158 A * 7/1996 Dresie et al. ..... 425/75
5,598,643 A * 2/1997 Chuang et al. ..... 34/406
5,619,806 A * 4/1997 Warren ..... 34/331
5,621,983 A * 4/1997 Lundemann et al. ..... 34/641
5,659,972 A * 8/1997 Min et al. ..... 34/255
5,689,900 A * 11/1997 Takayama et al. ..... 34/631
5,699,626 A * 12/1997 Chuang et al. ..... 34/453
5,701,682 A * 12/1997 Chuang et al. ..... 34/115
5,713,138 A * 2/1998 Rudd ..... 34/274
5,755,042 A * 5/1998 Takayama et al. ..... 34/613
5,758,237 A * 5/1998 Abramsohn ..... 399/249
5,813,133 A * 9/1998 Munter et al. ..... 34/248
5,813,134 A * 9/1998 Min et al. ..... 34/255
5,853,801 A 12/1998 Suga et al.
5,873,014 A * 2/1999 Knapp et al. ..... 399/249
5,881,476 A * 3/1999 Strobush et al. ..... 34/451
5,901,462 A * 5/1999 Rudd ..... 34/274
5,906,862 A * 5/1999 Yapel et al. ..... 427/378
5,912,072 A * 6/1999 Trokhan et al. ..... 428/315.5
5,942,322 A * 8/1999 Ensign et al. ..... 428/315.5
5,953,833 A * 9/1999 Rudd ..... 34/528
5,978,630 A * 11/1999 Chang et al. ..... 399/249
5,981,022 A * 11/1999 Min et al. ..... 428/98
6,021,583 A * 2/2000 Stelljes et al. ..... 34/618
6,047,151 A * 4/2000 Carvalho et al. ..... 399/250
6,090,243 A * 7/2000 Corbellini et al. ..... 162/206
6,161,301 A * 12/2000 Hoshi et al. ..... 34/111
6,223,449 B1 * 5/2001 Johnson et al. ..... 34/62
6,256,903 B1 * 7/2001 Rudd ..... 34/412
6,280,573 B1 * 8/2001 Lindsay et al. ..... 162/198
6,298,578 B1 * 10/2001 Frampton ..... 34/465
6,381,870 B1 * 5/2002 Kohlman et al. ..... 34/311
6,421,932 B2 * 7/2002 Gommori et al. ..... 34/488
6,533,217 B2 * 3/2003 Lind ..... 242/615.12
6,553,689 B2 * 4/2003 Jain et al. ..... 34/444
6,564,473 B2 * 5/2003 Aydore ..... 34/504
6,564,474 B2 * 5/2003 Nagashima ..... 34/638
6,579,418 B2 * 6/2003 Lindsay et al. ..... 162/198
6,637,128 B2 * 10/2003 Kuroiwa et al. ..... 34/629
6,658,760 B2 * 12/2003 Kohlman et al. ..... 34/311
6,665,952 B2 * 12/2003 Nagashima ..... 34/391
RE38,412 E * 2/2004 Munter et al. ..... 34/248
6,735,883 B1 * 5/2004 Bria et al. ..... 34/444
6,840,068 B2 * 1/2005 Pasin et al. ..... 68/5 C
7,032,324 B2 * 4/2006 Kolb et al. ..... 34/451
7,074,458 B2 * 7/2006 Ishizuka et al. ..... 427/379
7,100,302 B2 * 9/2006 Kolb et al. ..... 34/209
7,143,528 B2 * 12/2006 Kolb ..... 34/451
7,176,415 B2 * 2/2007 Kamitani et al. ..... 219/400
7,513,062 B2 * 4/2009 Achkire et al. ..... 34/482
7,526,878 B2 * 5/2009 Sonobe et al. ..... 34/266
7,765,920 B2 * 8/2010 Keller ..... 99/516
7,828,547 B2 * 11/2010 Gelbart ..... 432/8
7,918,038 B2 * 4/2011 Miller et al. ..... 34/445
7,918,039 B2 * 4/2011 Kolb ..... 34/445
2001/0015021 A1 * 8/2001 Gommori et al. ..... 34/492
2002/0004994 A1 * 1/2002 Rudd ..... 34/343
2002/0095818 A1 * 7/2002 Jain et al. ..... 34/448
2002/0112365 A1 * 8/2002 Kohlman et al. ..... 34/311
2003/0017310 A1 * 1/2003 Young ..... 428/195
2003/0051371 A1 * 3/2003 Ishizuka et al. ..... 34/444
2003/0074805 A1 * 4/2003 Aydore ..... 34/444
2003/0121170 A1 * 7/2003 Achkire et al. ..... 34/78
2003/0200672 A1 * 10/2003 Keller ..... 34/372
2003/0230003 A1 * 12/2003 Miller et al. ..... 34/444
2004/0118013 A1 * 6/2004 Kohlman et al. ..... 34/595
2004/0231185 A1 * 11/2004 Kolb ..... 34/500
2004/0231186 A1 * 11/2004 Kolb et al. ..... 34/500
2005/0016915 A1 * 1/2005 Beck ..... 210/490
2005/0126031 A1 * 6/2005 Herman et al. ..... 34/114
2005/0229426 A1 * 10/2005 Achkire et al. ..... 34/351
2005/0241177 A1 * 11/2005 Kolb et al. ..... 34/444
2005/0279471 A1 * 12/2005 Murray et al. ..... 162/111
2006/0179680 A1 * 8/2006 Miller et al. ..... 34/444
2006/0191160 A1 * 8/2006 Miller et al. ..... 34/444
2006/0292311 A1 * 12/2006 Kilburn et al. ..... 427/487
2007/0107254 A1 * 5/2007 Kolb ..... 34/449
2007/0119069 A1 * 5/2007 Shim ..... 34/96
2007/0227034 A1 * 10/2007 Ogawa et al. ..... 34/444
2008/0104861 A1 * 5/2008 Yahiro ..... 34/463
2008/0172903 A1 * 7/2008 Shimoda et al. ..... 34/423
2008/0206455 A1 * 8/2008 Sonobe et al. ..... 427/162
2009/0241365 A1 * 10/2009 Taguchi et al. ..... 34/389
2010/0043839 A1 * 2/2010 Hamada et al. ..... 134/30

FOREIGN PATENT DOCUMENTS

EP 560248 A2 * 9/1993
EP 581567 A1 * 2/1994
JP 57143727 A * 9/1982
JP 58145945 A * 8/1983
JP 58215651 A * 12/1983
JP 61293899 A * 12/1986
JP 62215956 A * 9/1987
JP 62242942 A * 10/1987
JP 63049760 A * 3/1988
JP 63143552 A * 6/1988
JP 63234257 A * 9/1988
JP 63236043 A * 9/1988
JP 01118840 A * 5/1989
JP 01214858 A * 8/1989
JP 01237659 A * 9/1989
JP 02038873 A * 2/1990
JP 03215039 A * 9/1991
JP 03280048 A * 12/1991
JP 04284451 A * 10/1992
JP 05107724 A * 4/1993
JP 05150438 A * 6/1993
JP 06083021 A * 3/1994
JP 06167796 A * 6/1994
JP 06167797 A * 6/1994
JP 06242589 A * 9/1994
JP 9-73081 A 3/1997
JP 2001-170547 A 6/2001
JP 2002036266 A * 2/2002
JP 2005115357 A * 4/2005

* cited by examiner

METHOD FOR DRYING APPLIED FILM AND DRYING APPARATUS

BACKGROUND OF THE INVENTION

1. Field of the Invention

The present invention relates to a method and apparatus for drying an applied film and, particularly, to a method for drying a long and wide applied film that is formed by applying an application liquid containing an organic solvent to a long support medium in the manufacture of an optical compensating sheet or the like, and a drying apparatus.

2. Description of the Related Art

In order to improve the viewing angle characteristics in a liquid crystal display, an optical compensating sheet is provided as a phase contrast sheet between a pair of polarizing sheets and a liquid crystal cell. A method of manufacturing long optical compensating sheets is disclosed in Japanese Patent Application Laid-Open No. 9-73081. Disclosed is a method that involves forming an oriented film by applying an application liquid containing an oriented film forming resin on a surface of a long transparent film and then performing rubbing treatment, applying an application liquid containing a liquid crystalline discotic compound to the oriented film, and drying the applied film.

In the method of drying an application liquid containing a liquid crystalline discotic compound disclosed in Japanese Patent Application Laid-Open No. 9-73081, initial drying is performed under indoor air-conditioned conditions for the duration from the application of an application liquid containing a liquid crystalline discotic compound to the oriented film to the drying by use of a regular drying apparatus, whereby mainly an organic compound contained in the application liquid is evaporated.

In an optical compensating sheet manufactured by this method, two types of surface irregularities A and B occur on an applied film surface 1 in the drying process as shown in FIG. 4, Type A being broad irregularities (indicated by thin lines) and Type B being sharp irregularities (indicated by thick lines), thereby posing the problem that this lowers the yield of products in some cases.

The two types of irregularities A and B were analyzed and as a result, it became apparent that in a broad irregularity A, as shown in FIG. 5, the thickness of the layer of an application liquid film 2 containing a liquid crystalline discotic compound has become small. In FIG. 5, reference numeral 3 designates a long support medium and reference numeral 4 designates an oriented film layer. On the other hand, it became apparent that, as shown in FIG. 6, the orientation direction 6 of an oriented portion 5 (a shaded portion) in which a sharp irregularity B occurs is displaced compared to other oriented portions 8 of a normal orientation direction 7.

As an effective measure against such irregularities A and B that occur in an initial drying, there is a method to prevent the occurrence of the irregularities that involves increasing the viscosity of an application liquid by raising the concentration of the application liquid or adding a thickener, thereby suppressing the flow of an applied film surface immediately after application by a drying wind. As another method, there is available a method that involves using a high boiling point solvent, whereby even in the case of the occurrence of the flow of an applied surface due to a drying wind immediately after application, the occurrence of irregularities is prevented due to the producing of the leveling effect.

However, the method that involves increasing the viscosity of an application liquid by raising the concentration of the application liquid or adding a thickener, has the disadvantage that it is impossible to perform ultrathin-layer precision application that involves forming an applied film of an ultrathin layer by high-speed application. Furthermore, this method has the disadvantage that because the higher the viscosity of an applied liquid, the lower the critical application speed (a limit to an application speed at which stable application is possible), the viscosity increases and high-speed application becomes impossible, thereby extremely deteriorating the production efficiency.

On the other hand, the method that involves using a high boiling point solvent brings about an increase in the drying time and an increase in the amount of a residual solvent remaining in an applied film and has the disadvantage that the production efficiency becomes worse because of a longer drying time.

As a method for solving these disadvantages, in Japanese Patent Application Laid-Open No. 2001-170547 are proposed a drying method and a drying apparatus which are such that a drying zone is provided immediately after application, an applied film surface of the traveling long support medium to be dried is enclosed, and a drying wind of a unidirectional flow that flows from the one-end side of the width direction of the long support medium to the other-end side thereof is generated in the drying zone, whereby an applied film can be uniformly dried without the need to change the physical properties, such as viscosity, of the application liquid and the kind of the solvent.

SUMMARY OF THE INVENTION

However, in the method disclosed in Japanese Patent Application Laid-Open No. 2001-170547, the drying delays on the recovery side at the other end of wind supply. Therefore, in order to complete drying within the drying apparatus, it is necessary to make fast the drying on the wind recovery side by increasing the wind velocity and the temperature of the drying wind. However, if this is performed, the drying on the wind supply side becomes fast. Consequently, surface irregularities could be formed in an applied film.

Particularly, when the thickness of an applied film is sufficiently small compared to the thickness of the support medium, the applied film immediately after application becomes apt to be affected by the temperature of the support medium and it is impossible to perform slow drying on the wind supply side, thereby, there was the problem that uniform drying of the applied film was difficult.

The present invention has been made in view of such circumstances and has an object to provide a drying method and an apparatus that are capable of uniformly drying an applied film in the initial drying of the applied film.

In a first aspect of the present invention, there is provided a method for drying an applied film formed by applying an application liquid containing an organic solvent to a traveling long support medium, wherein the temperature Tb of the long support medium before application is not less than 2° C. lower than the temperature Tc of the application liquid and the wind velocity in the vicinity of the applied film after application is not more than 0.5 m/s.

Paying attention to the fact that in drying an applied film formed by applying an application liquid containing an organic solvent to a traveling long support medium, drying irregularities are formed in the applied film when the drying speed of the application liquid in the applied film increases, the present inventor obtained the knowledge that by ensuring the temperature of the support medium before application is not less than 2° C. lower than the temperature of the applied film and that the wind velocity in the vicinity of the applied film after application is not more than 0.5 m/s, the formation of drying irregularities can be suppressed by making the drying speed slow during the drying of the applied film.

According to the first aspect of the present invention, the temperature Tb of the long support medium before application is set at not less than 2° C. lower than the temperature Tc of the application liquid and the wind velocity in the vicinity of the applied film after application is set at not more than 0.5 m/s. Therefore, it is possible to dry the applied film gently and to suppress the occurrence of drying irregularities in an applied film.

According to the first aspect of the present invention, the wind velocity in the vicinity of the applied film after application is not more than 0.5 m/s. Therefore, the wind that strikes against the applied film is a breeze and it is possible to ensure that a wind of nonuniform strength and direction does not strike against an applied film surface in the state that a large amount of organic solvent is contained therein and the application solvent tends to flow. Therefore, it is possible to uniformly dry an applied film without drying irregularities.

A second aspect of the present invention is characterized in that in the first aspect, the long support medium before the application is supported by a roll having a temperature-controlled surface, whereby the temperature Tb is not less than 2° C. lower than the temperature Tc.

According to the second aspect of the present invention, before the conveyance of the support medium to an applicator 20, the support medium is brought into contact with the roll having a temperature lower than the temperature of the applied film, whereby the temperature of the support medium is made lower than the temperature of the applied film. Therefore, it is possible to gently dry the applied film and to suppress the occurrence of drying irregularities in the applied film.

A third aspect of the present invention is characterized in that, in the first or second aspect, a drying zone is provided immediately after the application, whereby an applied film surface of the traveling long support medium to be dried is enclosed and a drying wind of unidirectional flow that flows in the drying zone from the one-end side in the width direction of the long support medium to the other-end side thereof is generated so that the wind velocity becomes not more than 0.5 m/s in the vicinity of the applied film.

According to the third aspect of the present invention, a drying zone is provided after application, preferably immediately after application. Therefore, it is ensured that a wind of nonuniform strength and direction from the outside of the drying zone does not strike against an applied film surface in the state that a large amount of organic solvent is contained therein and the application solution tends to flow, and an environment in which an applied film surface is covered by an organic solvent evaporated from the applied film surface is formed. When a regular drying wind of unidirectional flow that flows from one end in the width direction of the long support medium to the other end thereof is generated in this drying environment, it is possible to perform the drying of the applied film, with the concentration of the organic solvent in the vicinity of the applied film surface constantly kept at a constant level. Therefore, the occurrence of the above-described two types of irregularities during drying can be prevented and it is possible to perform uniform drying.

A fourth aspect of the present invention is characterized in that, in the third aspect, the temperature distribution in the width direction of the long support medium is made low on the air supply side of the drying wind.

According to the fourth aspect of the present invention, even if in the drying zone, a drying wind flows from the one-end side in the width direction of the support medium to the other-end side thereof and the temperature on the air supply side rises, this does not bring about such a condition that the temperature of the support medium might rise and supply heat to the applied film, because the temperature distribution in the width direction of the support medium is made low beforehand on the air supply side.

A fifth aspect of the present invention is characterized in that, in any of the first to fourth aspects, the long support medium has a layer that becomes an oriented layer by subjecting a pre-applied oriented film forming resin to rubbing treatment and that the application liquid contains a liquid crystalline discotic compound.

In a sixth aspect of the present invention, there is provided an apparatus for drying an applied film formed by applying an application liquid containing an organic solvent to a traveling long support medium by use of an applicator, which comprises: a roll the surface temperature of which is controlled so that the temperature Tb of the long support medium is not less than 2° C. lower than the temperature Tc of the application liquid; a drying apparatus main body that is provided immediately behind the applicator and forms a drying zone enclosing an applied film surface of the traveling long support medium to be dried; and a unidirectional airflow generating device that generates a drying wind having a unidirectional flow that flows in the drying zone from the one-end side in the width direction of the long support medium to the other-end side thereof and having a wind velocity of not more than 0.5 m/s in the vicinity of the applied film after application.

According to the method and apparatus for drying an applied film of the present invention, the drying irregularities that occur in the initial drying step immediately after application can be suppressed and it is possible to perform uniform drying.

Furthermore, because it is unnecessary to change the physical properties, such as viscosity, of an application liquid and the kind of a solvent, it is possible to increase the range of the kinds of application liquids and solvents capable of being used.

DETAILED DESCRIPTION OF THE PREFERRED EMBODIMENTS

The method and apparatus for drying an applied film of the present invention and preferred embodiments will be described below with reference to the accompanying drawings.

Figure 1:
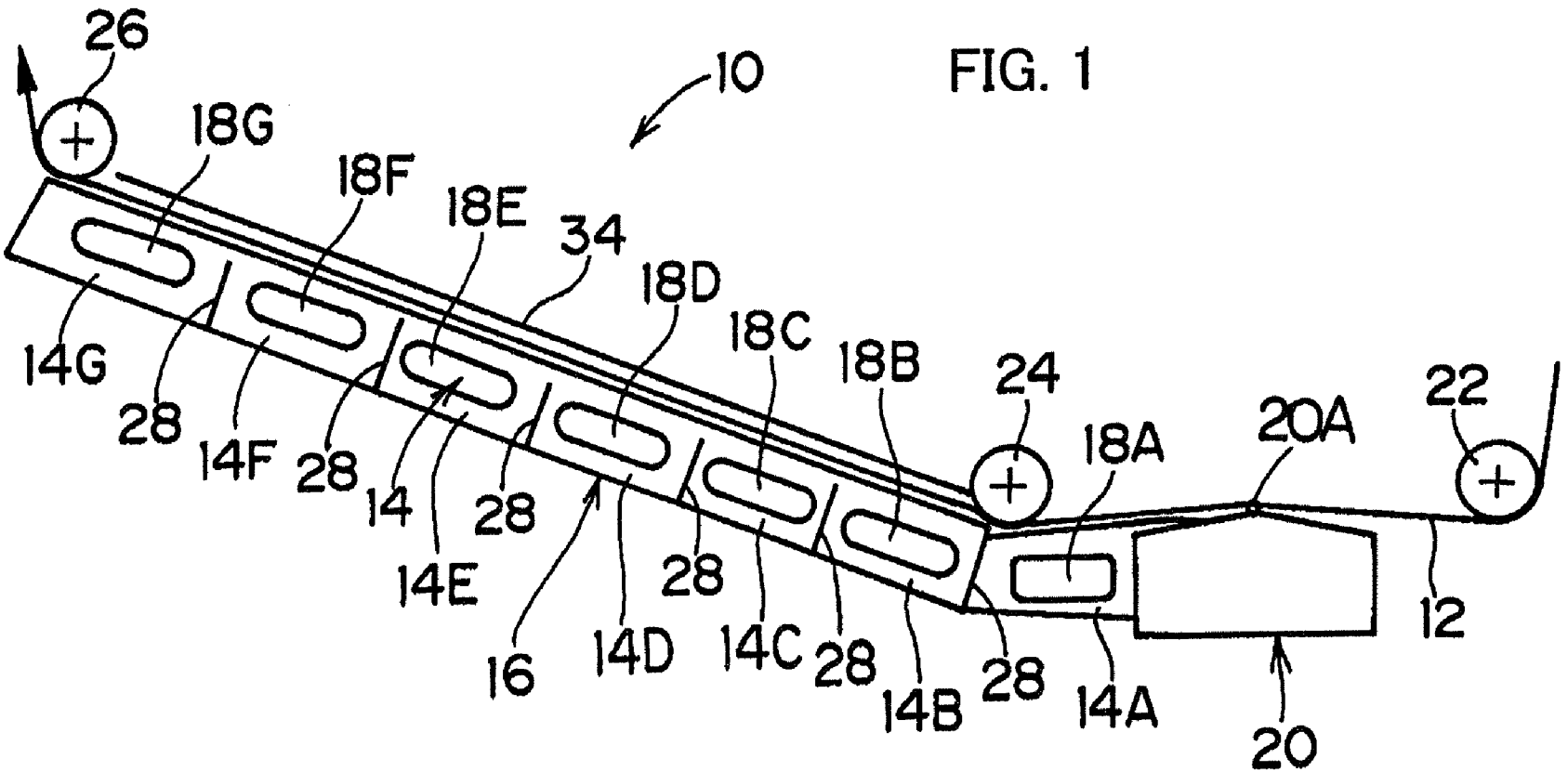
FIG. 1 is a side view of a drying apparatus of the present invention.
Figure 2:
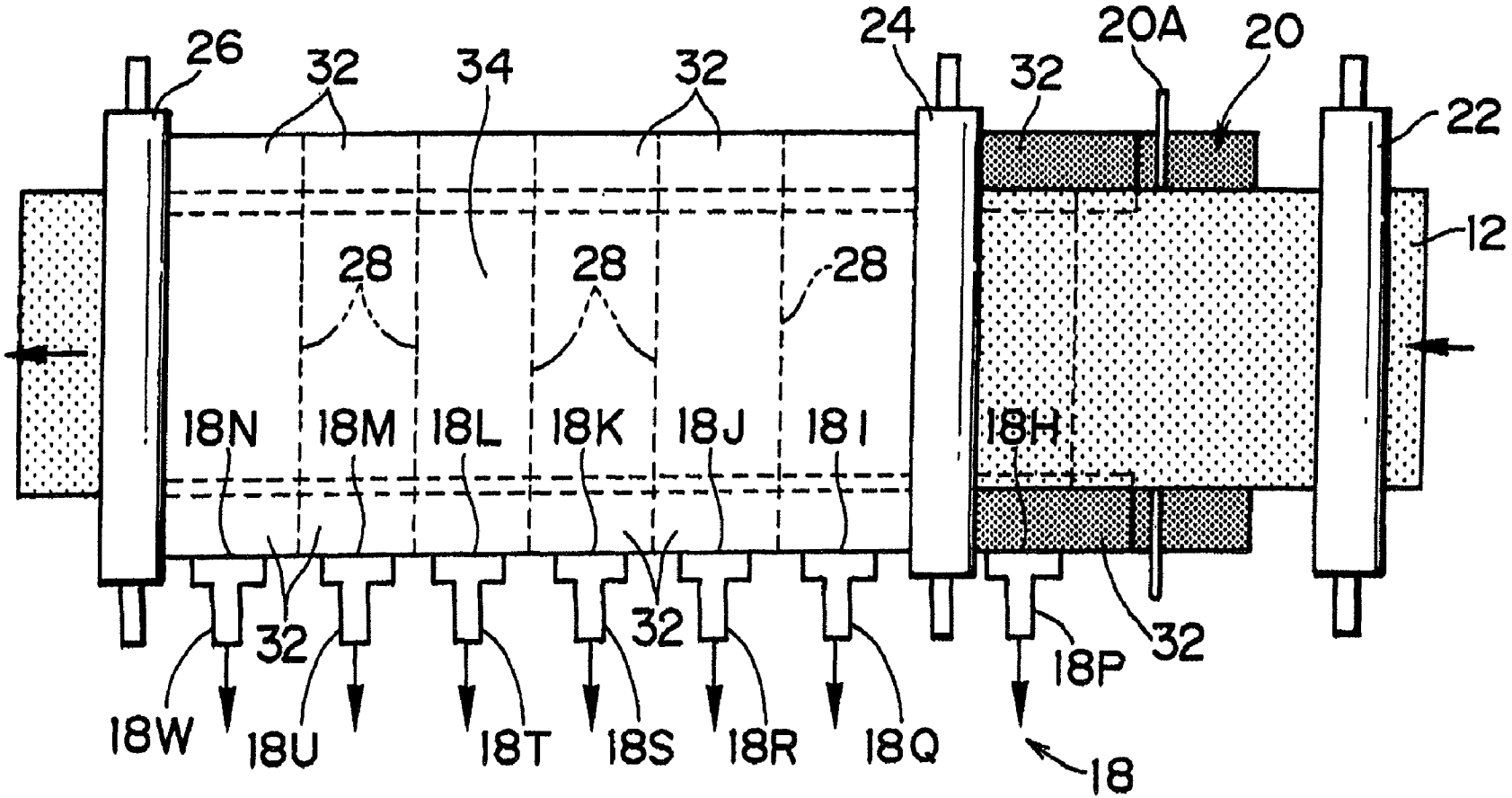
FIG. 2 is a plan view of a drying apparatus of the present invention.

FIG. 1 is a side view of a drying apparatus of the present invention, and FIG. 2 is a plan view of FIG. 1 as viewed from above.

As shown in FIGS. 1 and 2, an apparatus for drying an applied film of the present invention 10 is mainly composed of a drying apparatus main body 16, which forms a drying zone 14 in which the drying of an applied film is performed by causing a traveling long support medium 12 (hereinafter referred to as a "web 12") to pass through, and a unidirectional airflow generating device 18, which generates, in the drying zone 14, a drying wind having a unidirectional flow that flows in the drying zone from the one-end side in the width direction of the web 12 to the other-end side thereof. This drying apparatus 10 is provided immediately behind an applicator 20 that applies an application liquid containing an organic solvent to the traveling web 12.

For example, a bar applicator having a wire bar 20A can be used as the applicator 20, and an application liquid is applied to a bottom surface of the web 12 that travels by being supported by a plurality of backup rolls 22, 24, 26, whereby an applied film is formed. In this connection, it is preferred that the thickness of an applied film formed on the web 12 be not more than 7 μm. The reason for this is that if the thickness exceeds 7 μm, it is impossible to finish the drying of the applied film within the drying apparatus main body 16. Incidentally, more preferably, the thickness is not more than 5 μm.

The backup roll 22 is constructed so that the surface temperature thereof can be controlled. For example, the interior of the backup roll 22 is such that the surface temperature can be controlled by circulating a liquid medium, such as water. And by controlling the surface temperature of this backup roll 22, it is ensured that the temperature Tb of the web 12 upon entrance into the applicator 20 can be controlled. Incidentally, the control of the temperature Tb of the web 12 before application may be performed by use of the backup roll 22 or a roll provided on the upstream side thereof. In this case, the surface temperature of each roll may be controlled by a liquid of a jacket roll or may also be controlled by blowing a wind whose temperature is controlled on each roll. In this connection, the temperature Tb of the web 12 upon entrance into the applicator 20 is controlled so as to be 2° C. or more lower than the temperature Tc of the application liquid. That is, the temperature Tb of the web 12 upon entrance into the applicator 20 is controlled so that a difference between the temperature Tc of the application liquid and the temperature Tb of the web 12, ΔT (=Tc−Tb), becomes not less than 2° C. More preferably, control is performed so that ΔT becomes not less than 2° C. but no more than 20° C. In this connection, when there are variations in the temperature of the web 12 in the width direction, it is preferred that a maximum temperature difference be ΔT. Incidentally, it is preferably constructed that also the surface temperature of the backup roll 24 is similarly controlled.

And it is preferably constructed that the surface temperature of the backup roll 22 has a temperature gradient in the width direction of the web 12. Concretely, it is preferred that a temperature gradient be provided so that the temperature rises from the air inlet port side of a unidirectional airflow device 18, which will be described later, to the air outlet port side thereof with respect to the width direction of the web 12.

Incidentally, although the temperature of the web 12 may be controlled by use of the backup rolls 22, 24 whose temperature is controlled as described above, the surface temperature of the web 12 may also be controlled by controlling the room temperature of a room through which the web 12 passes to a desired value. As a result of this, it is possible to make the construction of the drying apparatus simple.

The drying apparatus main body 16 that is provided immediately behind the applicator 20 is formed in the shape of an oblong box along the applied film surface side (the bottom surface side of the web) of the traveling web 12, and the side on the applied film surface side (the top side of the box) is cut off among the four sides of the box. As a result, the drying zone 14 that encloses an applied film surface of the traveling web 12 to be dried is formed. The drying zone 14 is divided into a plurality of divided zones 14A, 14B, 14C, 14D, 14E, 14F, 14G (seven divided zones in this embodiment) by partitioning the drying apparatus main body 16 with a plurality of partition plates 28, 28 . . . that are orthogonal to the traveling direction of the web 12. In this case, the distance from the top end of the partition plate 28 that divides the drying zone 14 to an applied film surface formed on the web 12 is preferably in the range of not less than 0.5 mm but not more than 12 mm, more preferably in the range of not less than 1 mm but not more than 10 mm. In the drying zone 14, a unidirectional airflow generating device 18 (see FIG. 2) is provided.

The unidirectional airflow generating device 18 is mainly constituted by air inlet ports 18A, 18B, 18C, 18D, 18E, 18F, 18G that are formed on one side of the two sides of the drying apparatus main body 16, air outlet ports 18H, 18I, 18J, 18K, 18L, 18M, 18N that are formed opposite to the air inlet ports 18A to 18G, and exhaust devices 18P, 18Q, 18R, 18S, 18T, 18U, 18W that are connected to the air outlet ports 18H to 18N. As a result, because the air sucked from the air inlet ports 18A to 18G into the divided zones 14A to 14G is exhausted by driving the exhaust devices 18P to 18W, a drying wind that flows from the one-end side (air inlet port side) in the width direction of the web 12 to the other-end side (air outlet port side) thereof is generated in each of the divided zones 14A to 14G. This unidirectional airflow generating device 18 can control the exhausted air volume for each of the divided zones 14A to 14G individually by use of the exhaust devices 18P to 18W. An air-conditioned wind whose temperature and humidity are conditioned is desirable as the drying wind sucked in from the air inlet ports 18A to 18G. Incidentally, because an applied film formed on the web 12 is dried with a breeze, the driving output of the exhaust devices 18P to 18W is controlled so that the wind velocity of a drying wind that flows in one direction from the one-end side (air inlet port side) in the width direction of the web 12 to the other-end side (air outlet port side) thereof becomes not more than 0.5 m/s. The reason for this is that if the wind velocity of a drying wind exceeds 0.5 m/s, it becomes impossible to ensure that the concentration of an organic solvent in the vicinity of an applied film surface is uniform, with the result that it becomes impossible to uniformly evaporate the organic solvent from each part of the applied film surface.

Although as the drying wind it is possible to use an air-conditioned wind of, for example, an air-conditioning room where the drying apparatus 10 is installed, it is also possible to adopt a method which is such that a wind containing the same solvent as organic solvent contained in the application liquid is sucked in from the air inlet ports 18A to 18G of the drying apparatus main body 16. Or alternatively, part of the drying wind exhausted by the exhaust devices 18P to 18W may be sucked in from the air inlet ports 18A to 18G.

The drying apparatus main body 16 is constructed in such a manner that the width thereof is formed to be larger than the width of the web 12 and an air regulating portion is provided by covering the open area on both sides of the drying zone 14 with a wind regulating plate 32. This wind regulating portion secures the distance from the air inlet ports 18A to 18G to the applied film end and the distance from the applied film end to the air outlet ports 18H to 18N, and at the same time ensures that a drying air is easily sucked from only the air inlet ports 18A to 18G into the drying zone 14 so that an abrupt flow of a drying wind is not formed in the drying zone 14. It is preferred that the length of this wind regulating portion, i.e., the wind regulating plate 32 on both of air inlet port side and the air outlet port side be within the range of not less than 50 mm but not more than 150 mm.

For the divided zone 14A that is closest to the applicator among the divided zones 14A to 14G, it is important that immediately after the application of an application liquid to the web 12, the fresh air outside the drying zone 14, for example, the above-described air-conditioned wind do not easily enter the drying zone 14. For this purpose, in addition to the arrangement of the divided zone 14A adjacent to the applicator 20 and the above-described wind regulating plate 32, it is preferred that the web 12 be caused to travel very near the divided zone 14A by adjusting the position of the wire bar 20A of the applicator 20 and the position of the backup roll 24, whereby as if the open area of the divided zone 14A were covered with the web 12.

On the opposite side position to the drying apparatus main body 16, with the web 12 interposed, a shielding plate 34 is provided so that a stable travel of the web 12 is not hindered by a wind, such as the above-described air-conditioning wind.

Next, the operation of the drying apparatus 10 constructed as described above will be described.

Incidentally, the description is given of a case where the web 12 has a layer that becomes an oriented film by subjecting a pre-applied oriented film forming resin to rubbing treatment and the application liquid is an organic solvent containing a liquid crystalline discotic compound.

Immediately after the application of an application liquid to the web 12 traveling while the web 12 is being supported by the backup rolls 22, 24, 26 by use of the wire bar 20A of the applicator 20, the initial drying of an applied film surface is performed by the drying apparatus 10. It is preferred that this initial drying be started with a drying wind immediately after application, at latest within 5 seconds immediately after application.

In this initial drying, the applied film surface immediately after application is in a condition in which an organic solvent is sufficiently contained, and particularly, in the initial drying immediately after the application of an application liquid containing an organic solvent as the solvent, temperature distribution occurs on the applied film surface due to the distribution (fluctuation) of evaporation of the organic solvent. This causes the distribution of surface tension to occur and causes the flow of the application liquid in the applied film surface and the application film to be thin in a portion where the drying is slow, with the result that broad irregularities A occur.

The orientation direction of a liquid crystalline discotic compound is determined by subjecting the surface of an oriented film forming resin to rubbing treatment. When the wind velocity in the direction of the wind is different from the rubbing direction in the initial drying, when winds join together, when wind whirls occur, and the like, the striking of a wind against the applied film surface generates a deviation in the orientation direction in part of the applied film surface, thereby causing sharp irregularities B.

From this fact, in order to prevent irregularities A and B during initial drying, it is important to prevent a nonuniform wind from the outside from striking against the applied film surface during the initial drying for a duration from the application to the stop of the flow of the application liquid on the applied film surface and to constantly keep the concentration of an organic solvent in the vicinity of the applied film surface at a constant level.

This is more important on the air supply side where initial drying occurs early. In the present invention, immediately after the application of the application liquid to the web 12, the support medium temperature before application is controlled so that the application liquid is not dried too rapidly in the initial drying.

A detailed description will be given here of the meaning of temperature control of the web 12 before application in this embodiment.

When an applied liquid is dried by evaporation after being applied to a support medium, the latent heat of evaporation is deprived from the applied film and, therefore, the temperature of the applied film drops. However, when the thickness of the web 12 is sufficiently large compared to the thickness of the applied film, heat is supplied from the web 12 to the applied film. Therefore, the higher the temperature of the web 12, the more rapidly the application liquid evaporates to be dried rapidly, with the result that drying irregularities will occur in the applied film. Particularly, in this embodiment, the wind velocity of the drying wind is regulated to not more than 0.5 m/s in order to prevent irregularities caused by the turbulence of the drying wind due to the thin-layer application of an organic solvent and, therefore, the effect of the heat of the web 12 is significant.

In this embodiment, therefore, immediately after the application of an application liquid to the web 12, the temperature of the web 12 before application is controlled so that initial drying is not rapidly performed. That is, the temperature of the web 12 before application is beforehand not less than 2° C. lower than the temperature of the applied film. As a result of this, the application liquid is slowly evaporated and, therefore, rapid drying can be prevented.

According to this embodiment described above, even when the thickness (5 μm) of the applied film is small compared to the thickness of the web 12, the temperature Tb of the web 12 before application is set not less than 2° C. lower than the temperature Tc of the application liquid and the wind velocity in the vicinity of the applied film after application is set at not more than 0.5 m/s. Therefore, the application liquid is slowly evaporated from the applied film and drying irregularities do not occur in the applied film after drying. Thus, it is possible to obtain a uniform applied film.

Examples of the web 12 used in the present invention includes a plastic film of polyethylene terephtalate, polyethylene-2,6 naphthalate, cellulose diacetate, cellulose triacetate, cellulose acetate propionate, polyvinyl chloride, polyvinylidene chloride, polycarbonate, polyimide, polyamide, paper, paper to which polyethylene, polypropylene, $C_{2-10}$ α-polyolefins of ethylene butane copolymers and the like are applied or laminated, metal foils of aluminum, copper, tin and the like, and strip-like base materials on the surfaces of which a preliminary processed layer is formed, all generally having a width of not less than 0.3 m but not more than 5 m, a length of not less than 45 m but not more than 10000 m, and a thickness of not less than 5 μm but not more than 200 μm. Furthermore, the above-described web 12 includes those which have a surface to which an optical compensating sheet application liquid, a magnetic application liquid, a photosensitive application liquid, a surface protective application liquid, antistatic application liquid, a lubricity application liquid and the like are applied and which are cut to desired lengths and widths after drying, and representative examples of them include an optical compensating sheet, various types of photographic films, photographic paper, magnetic tape and the like.

As the method of applying an application liquid, it is possible to use the curtain coating method, the extrusion coating method, the roll coating method, the dip coating method, the spin coating method, the printing coating method, the spray coating method and the slide coating method in addition to the above-described bar coating method. Particularly, the bar coating method, the extrusion coating method and the slide coating method can be advantageously used.

The number of applied layers of an application liquid applied simultaneously in the present invention is not limited to a single layer and the present invention can also be applied to the simultaneous multi-layer application method as required.

EXAMPLES

Figure 3:
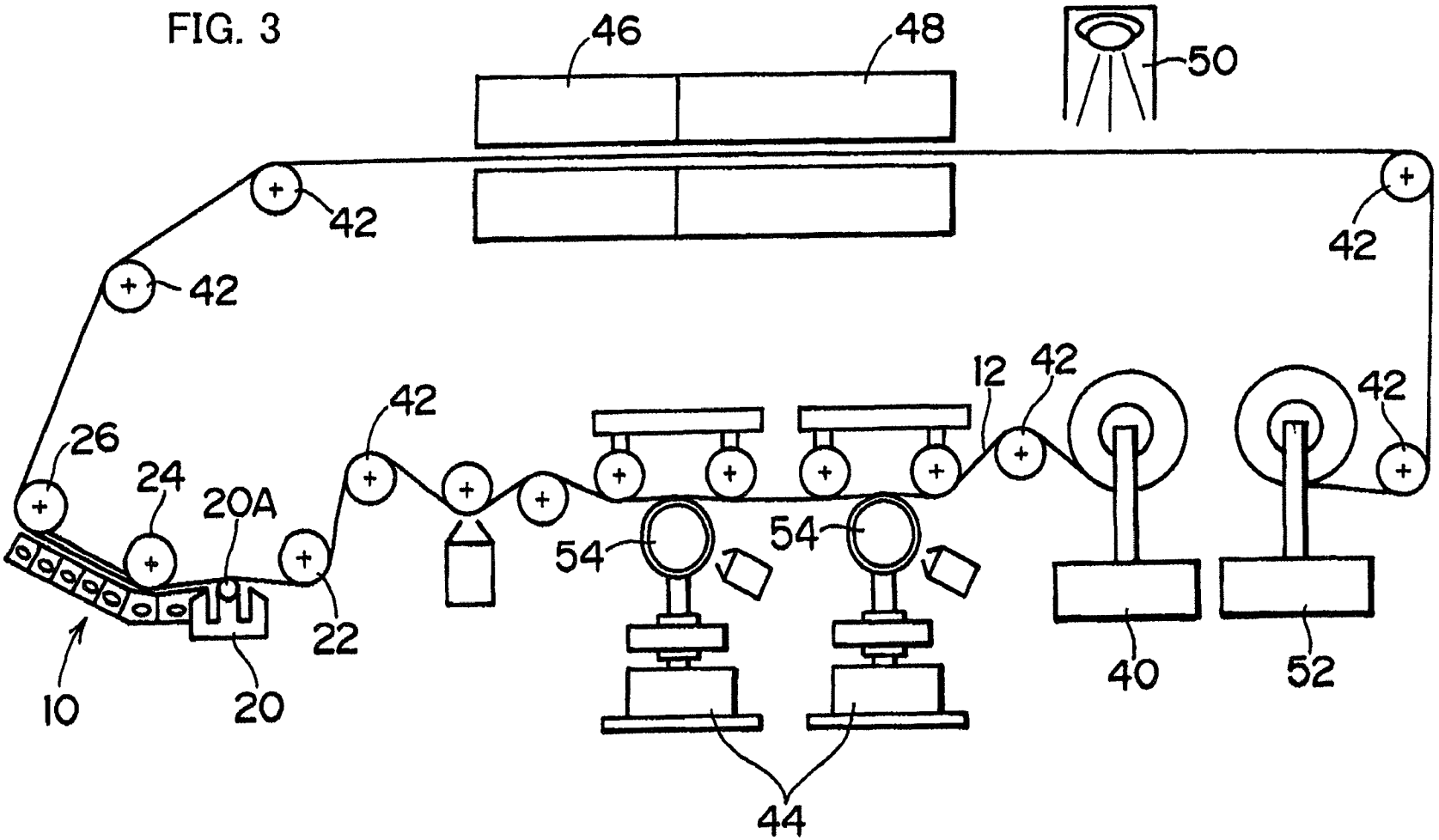
FIG. 3 is a process drawing showing a drying apparatus of the present invention incorporated in the manufacturing process of optical sheet compensating sheets.
Figure 4:
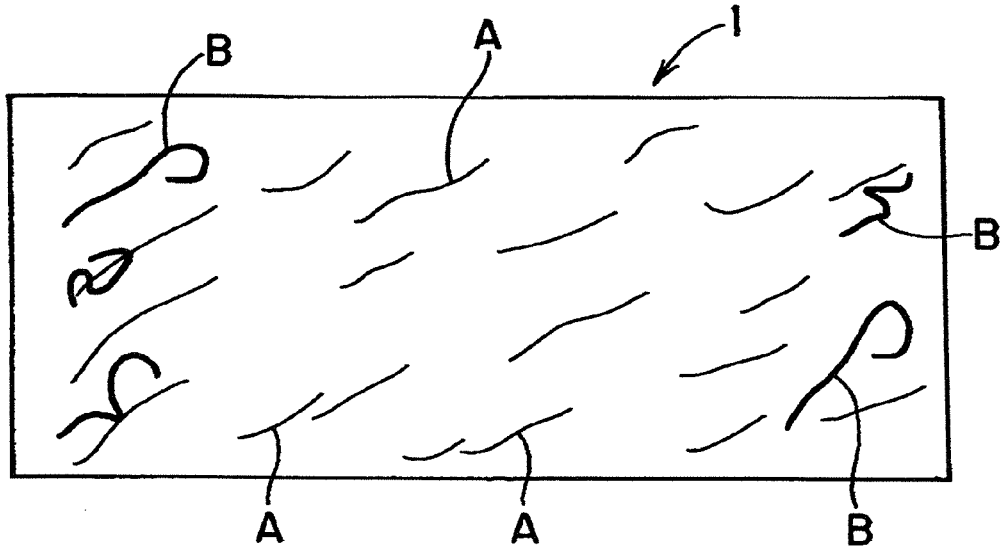
FIG. 4 is a diagram showing the condition of irregularities occurring under a conventional drying method.
Figure 5:
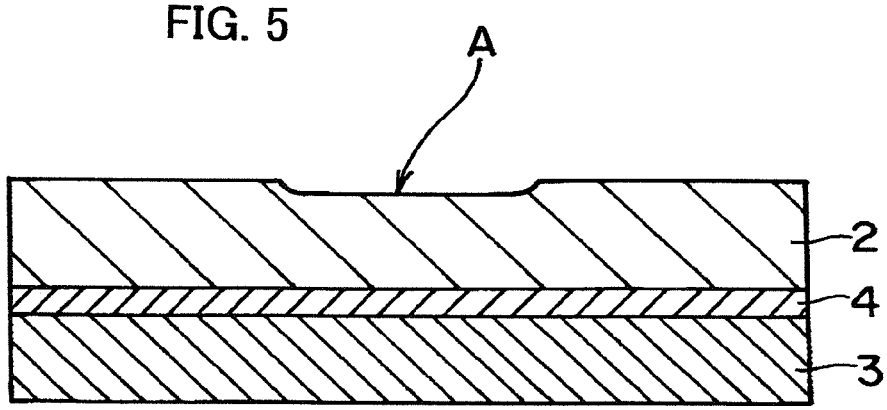
FIG. 5 is an explanatory diagram to explain broad irregularities.
Figure 6:
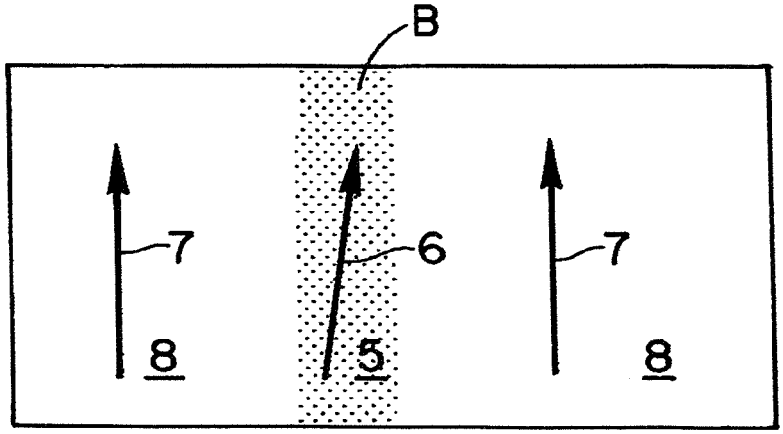
FIG. 6 is an explanatory diagram to explain sharp irregularities.

FIG. 3 is a process drawing showing the drying apparatus 10 of the present invention incorporated in the manufacturing process of optical sheet compensating sheets. The effect obtained when the exhausted air volume of the exhaust devices 18P to 18W of the drying apparatus 10 is adjusted was examined with respect to the occurrence condition of irregularities of manufactured optical compensating sheets.

For the exhausted air volume of the exhaust devices 18P to 18W of the drying apparatus 10, the wind velocity of the drying wind that flows in the divided zones 14A to 14G is in each of the examples and comparative examples is shown in Table 1.

First, the manufacturing process of optical compensating sheets is described. As shown in FIG. 3, a web 12 delivered by a delivery device 40, while being supported by a plurality of guide rolls 42, 42, . . . passes through a rubbing treatment device 44, an applicator 20, the drying apparatus 10 of the present invention that performs initial drying, a drying zone 46 that performs regular drying, a heating zone 48, and an ultraviolet lamp 50, and is wound up by a coiler 52.

Triacetyl cellulose (FUJITAC made by FUJIFILM Corporation) having a thickness of 100 μm was used as the web 12. And after the application of 25 ml of a 2 wt. % solution of linear alkyl denatured poval per 1 $m^2$ of film to the surface of the web 12, an oriented film forming resin was formed on the web 12 by performing drying at 60° C. for 1 minute, and the surface of the resin layer was subjected to rubbing treatment while the web 12 was being conveyed and caused to travel at 18 m/min, whereby an oriented film was formed. The pressing pressure of a rubbing roll 54 in the rubbing treatment was 98 Pa (10 kgf/$cm^2$) per $cm^2$ of the oriented film resin layer and the rotation circumferential speed was 5.0 m/s.

And an application liquid containing a liquid crystalline compound that is a 40 wt % methyl ethyl ketone solution of a mixture obtained by adding 1 wt % of a photopolymerization initiator (IRGACURE 907 made by Nihon Ciba-Geigy K.K.) to a mixture of discotic compounds, TE-8(3) and TE-8(5), at a weight ratio of 4:1, was used as the application liquid on the oriented film obtained by the rubbing treatment of the oriented film resin layer. While the web 12 was caused to travel at a travel speed of 18 m/minute, this application liquid was applied to the oriented film by use of a wire bar 20 A so that the amount of the application liquid became 5 ml per 1 $m^2$ of the web.

As shown in Table 1, the thickness of the applied film formed on the web 12 was 5 μm in Example 1 and Comparative Examples 1 to 3 and 7 μm in Examples 2 to 4.

The temperature (Tb) of the web 12 before application and temperature (Tc) of the application liquid were set at values as shown in Table 1. In each case, a temperature difference ΔT (=Tc−Tb) between the temperature of the application liquid (Tc) and the temperature of the web 12 before application (Tb) was calculated, and the results are shown in Table 1. Incidentally, in Example 4, a temperature gradient was provided in the temperature distribution in the width direction of the web 12 so that the temperature of the drying wind on the air supply side became 23° C. and the temperature of the drying wind in the middle and on the air exhaust side became 25° C. Therefore, the ΔT value became 4.5° C. on the air supply side of the drying wind and 2.5° C. in the middle and on the air exhaust side.

And immediately after application, in the drying apparatus 10 of the present invention, initial drying was performed with the drying wind shown in Table 1.

The spacing between the top ends of partition plates 28 that divide the drying zone 14 into seven parts and the applied film surface was set at the range of 5 to 9 mm. The web 12 subjected to initial drying in the drying apparatus 10 of the present invention was caused to pass through a drying zone 46 whose temperature was adjusted to 100° C. and a drying zone 48 whose temperature was adjusted to 130° C., whereby a nematic phase was formed. After that, while the web 12 to which this oriented film and the liquid crystalline compounds were applied was continuously conveyed, the surface of the liquid crystal layer was irradiated with ultraviolet rays from the ultraviolet lamp 50.

Incidentally, for the occurrence condition of irregularities in Table 1, the mark of a "B" means that irregularities occurred and the "G" means that no irregularity occurred.

TABLE 1

| | Maximum wind velocity of drying wind m/s | Thickness of applied film (μm) | Temperature (° C.) Support medium before application (Tb) Air supply side | Middle | Air exhaust side | Temperature of application liquid (Tc) | Temperature of drying wind | ΔT (= Tc − Tb) | Irregularities of applied film Broad irregularities A | Sharp irregularities B | Others | Temperature adjustment in width direction by jacket roll |
|---|---|---|---|---|---|---|---|---|---|---|---|---|
| Ex. 1 | 0.5 | 5 | 23 | 23 | 23 | 27.5 | 26 | 4.5 | G | G | | Without |
| Ex. 2 | 0.5 | 7 | 25 | 25 | 25 | 27.5 | 26 | 2.5 | G | G | | Without |
| Ex. 3 | 0.5 | 7 | 25.5 | 25.5 | 25.5 | 27.5 | 26 | 2.0 | G | G | | Without |
| Ex. 4 | 0.5 | 7 | 23 | 25 | 25 | 27.5 | 26 | Air supply side: 4.5 Air exhaust side: 2.5 | G | G | | With |
| Com. Ex. 1 | 0.5 | 5 | 26 | 26 | 26 | 27.5 | 26 | 1.5 | B | B | — | Without |

TABLE 1-continued

| | Maximum wind velocity of drying wind m/s | Thickness of applied film (μm) | Temperature (° C.) Support medium before application (Tb) Air supply side | Middle | Air exhaust side | Temperature of application liquid (Tc) | Temperature of drying wind | ΔT (= Tc − Tb) | Irregularities of applied film Broad irregularities A | Sharp irregularities B | Others | Temperature adjustment in width direction by jacket roll |
|---|---|---|---|---|---|---|---|---|---|---|---|---|
| Com. Ex. 2 | 0.5 | 5 | 26 | 26 | 26 | 27.5 | 37 | 1.5 | B | B | — | Without |
| Com. Ex. 3 | 0.6 | 5 | 26 | 26 | 26 | 27.5 | 26 | 1.5 | Air supply side: B | Air supply side: B | | Without |

As shown in Table 1, in Examples 1 to 3, even when a thin applied film having a film thickness of 5 μm or 7 μm is formed on the web 12, because of the lower temperature Tb of the web 12 than the temperature Tc of the application liquid Tc by not less than 2° C., neither broad irregularities A nor sharp irregularities B appear on the applied film and it is apparent that the applied film can be uniformly dried.

As shown in Example 4, when a temperature gradient is provided in the temperature distribution in the width direction of the web 12 by use of a jacket roll, neither broad irregularities A nor sharp irregularities B appear on the applied film and it is apparent that the applied film can be uniformly dried.

On the other hand, as shown in Comparative Examples 1 to 3, when the temperature difference between the temperature Tb of the web 12 and the temperature Tc of the application liquid is less than 2° C., broad irregularities A and sharp irregularities B appear on the applied film and it is apparent that the applied film cannot be uniformly dried.

As described above, when the drying apparatus 10 is installed immediately after application, drying with a breeze is performed at a wind velocity of not more than 0.5 m/s and the temperature difference ΔT between the temperature (Tc) of the application liquid and the temperature (Tb) of the web before application is set at not less than 2° C., neither broad irregularities A nor sharp irregularities B appear on the applied film. From this, it became apparent that this method was effective in suppressing irregularities that occur in the initial drying process.

What is claimed is:

1. A method for drying an applied film formed by applying an application liquid containing an organic solvent to a traveling long support medium, wherein the temperature Tb of the long support medium before application is not less than 2° C. lower than the temperature Tc of the application liquid, wherein the long support medium before the application is supported by a roll having a temperature-controlled surface, whereby the temperature Tb is not less than 2° C. lower than the temperature Tc, and wherein the wind velocity in the vicinity of the applied film after application is not more than 0.5 m/s, and wherein the thickness of an applied film is not more than 7μm.

2. The method for drying an applied film according to claim 1, wherein a drying zone is provided immediately after the application, whereby an applied film surface of the traveling long support medium to be dried is enclosed and a drying wind of unidirectional flow that flows in the drying zone from the one-end side in the width direction of the long support medium to the other-end side thereof is generated so that the wind velocity becomes not more than 0.5 m/s in the vicinity of the applied film.

3. The method for drying an applied film according to claim 2, wherein the temperature distribution in the width direction of the long support medium is made low on the air supply side of the drying wind.

4. The method for drying an applied film according to claim 1, wherein the long support medium has a layer that becomes an oriented film by subjecting a pre-applied oriented film forming resin to rubbing treatment and the application liquid contains a liquid crystalline discotic compound.

5. The method for drying an applied film according to claim 2, wherein the long support medium has a layer that becomes an oriented film by subjecting a pre-applied oriented film forming resin to rubbing treatment and the application liquid contains a liquid crystalline discotic compound.

6. The method for drying an applied film according to claim 3, wherein the long support medium has a layer that becomes an oriented film by subjecting a pre-applied oriented film forming resin to rubbing treatment and the application liquid contains a liquid crystalline discotic compound.

7. An apparatus for drying an applied film formed by applying an application liquid containing an organic solvent to a traveling long support medium by use of an applicator, comprising:

a roll the surface temperature of which is controlled so that the temperature Tb of the long support medium is not less than 2° C. lower than the temperature Tc of the application liquid;

a drying apparatus main body that is provided immediately behind the applicator and forms a drying zone enclosing an applied film surface of the traveling long support medium to be dried; and a unidirectional airflow generating device that generates a drying wind having a unidirectional flow that flows in the drying zone from the one-end side in the width direction of the long support medium to the other-end side thereof and having a wind velocity of not more than 0.5 m/s in the vicinity of the applied film after application, and wherein the thickness of an applied film is not more than 7 μm.

8. The method for drying an applied film according to claim 1, wherein the applied film is dried in an optical sheet.

* * * * *